United States Patent [19]

Munekata et al.

[11] 4,179,854

[45] Dec. 25, 1979

[54] GRINDING MACHINE WITH REST APPARATUS

[75] Inventors: Kenichi Munekata, Kariya; Takeshi Ohta, Aichi; Susumu Ohshima, Okazaki, all of Japan

[73] Assignee: Toyoda Koki Kabushiki Kaisha, Aichi, Japan

[21] Appl. No.: 925,878

[22] Filed: Jul. 18, 1978

[51] Int. Cl.[2] ..... B24B 49/04

[52] U.S. Cl. ..... 51/165.77; 51/105 SP; 51/165.91; 51/238 S

[58] Field of Search ..... 51/165 R, 165.71, 165 TP, 51/165.77, 165.91, 105 SP, 105 R, 238 S; 318/571

[56] References Cited

U.S. PATENT DOCUMENTS

| | | | |
|---|---|---|---|
| 3,846,689 | 11/1974 | Possati | 51/165.91 |
| 3,852,920 | 12/1974 | Takida | 51/165.91 X |
| 3,898,440 | 8/1975 | Fukuma | 51/165.91 |
| 3,967,414 | 7/1976 | Tamesui | 51/165.77 |
| 4,110,674 | 8/1978 | Enomoto | 318/571 |
| 4,139,969 | 2/1979 | Brown | 51/165.77 |

*Primary Examiner*—Harold D. Whitehead

*Attorney, Agent, or Firm*—Oblon, Fisher, Spivak, McClelland & Maier

[57] ABSTRACT

In a grinding machine, a grinding wheel is digitally fed toward a workpiece being supported by a rest apparatus. Means is provided to measure a diametral dimension of the workpiece during a grinding operation. A taper amount of the workpiece ground under the support of the rest apparatus being positioned at its advanced position is calculated at the time when the measuring means generates a signal for finishing a grinding operation on the workpiece. An advanced position of the rest apparatus is compensated for a next grinding operation in response to the calculated taper amount.

5 Claims, 4 Drawing Figures

GRINDING MACHINE WITH REST APPARATUS

BACKGROUND OF THE INVENTION

1. Field of the Invention

The present invention relates to a grinding machine with a rest apparatus capable of keeping a taper amount of a finished workpiece within a reference limit.

2. Brief Description of the Prior Art

In a conventional grinding machine with a rest apparatus, rest shoes of the rest apparatus has been fed toward a workpiece during a grinding cycle and a feed amount of the rest shoes has been controlled by a sizing device for measuring a diametral dimension of the workpiece during the grinding operation. Accordingly, it has been difficult to substantially eliminate a taper of the workpiece which is created during the grinding operation, although the taper is compensated to a certain extent before the finish of the grinding operation. More specifically, elastic energy based upon grinding resistance of a grinding wheel is stored on the rest apparatus. Therefore, even if a deflection of the workpiece is corrected by the feed of the rest shoes during the grinding operation so as to compensate for the taper of the workpiece, the rest apparatus is elastically restored when the grinding resistance becomes small in such a case as a fine grinding operation, whereby the deflection is still left on the workpiece, and as a result, the taper of the workpiece remains unremoved. Furthermore, dispersion of the taper is increased by the change in cutting ability of the grinding wheel. Accordingly, a tolerable accuracy has not been satisfied.

A change in a taper amount of a workpiece ground in the conventional manner within an interval between two consecutive dressing operations is shown in a dotted line in FIG. 4. It is seen that a taper of the workpiece tends to be negative while a cutting ability of the grinding wheel is large, that is, while a number of workpieces being ground is small, and that the taper tends to be positive and to be increased when the cutting ability is decreased. It is assumed from this result that elastic deformation of the rest apparatus caused by the feed movements of the rest shoes and the grinding wheel is restored during the time from the taper compensation grinding to the finish of the grinding, and the workpiece is deflected toward the grinding wheel at the time of the finish of the grinding while the cutting ability of the grinding wheel is large, whereby the taper tends to be negative. It is also assumed that the amount of elastic restoration of the rest apparatus is decreased when the cutting ability is decreased, whereby the taper tends to be positive and to be increased.

SUMMARY OF THE INVENTION

It is an object of the present invention to provide a new and improved grinding machine capable of keeping a taper amount of a finished workpiece within a reference limit.

Another object of the present invention is to provide a new and improved grinding machine wherein a taper amount of a workpiece ground under the support of rest shoes being positioned at their advanced positions is calculated at the time when measuring means for measuring a diametral dimension of a workpiece generates a signal for finishing a grinding operation on the workpiece and advanced positions of the rest shoes for a next grinding operation are compensated based upon the calculated taper amount in order to keep a taper amount of the workpiece within a reference limit.

Briefly, according to the present invention, these and other objects are achieved by providing a grinding machine for grinding a workpiece, as mentioned below. Means is mounted on a bed for rotatably supporting a workpiece. First drive means rotates the workpiece. A wheel head is slidably mounted on the bed. A grinding wheel is rotatably supported on the wheel head. Second drive means rotates the grinding wheel. A first servomotor moves the wheel head so as to move the grinding wheel toward and away from the workpiece. A rest apparatus is provided comprising a pair of rest shoes movable toward the workpiece to support the same. A second servomotor moves the rest shoes. Means is provided for measuring a diametral dimension of the workpiece during a grinding operation. A main control circuit enables an automatic grinding operation in a sequential manner. First presetting means digitally presets a variety of feed amounts. Second presetting means digitally presets a variety of feed speeds. A digital feed device responsive to the measuring means and the main control circuit selectively selects one of the feed speeds preset in the first presetting means and one of the feed amounts preset in the second presetting means to cause one of the first and second servomotors to move one of the wheel head and the pair of rest shoes at a selected feed speed through a selected feed amount. Means is provided for calculating a taper amount of a workpiece ground under the support of the rest shoes being positioned at their advanced positions at the time when the measuring means generates a signal for finishing a grinding operation on the workpiece. Means responsive to the calculating means compensates for advanced positions of the rest shoes for a next grinding operation.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
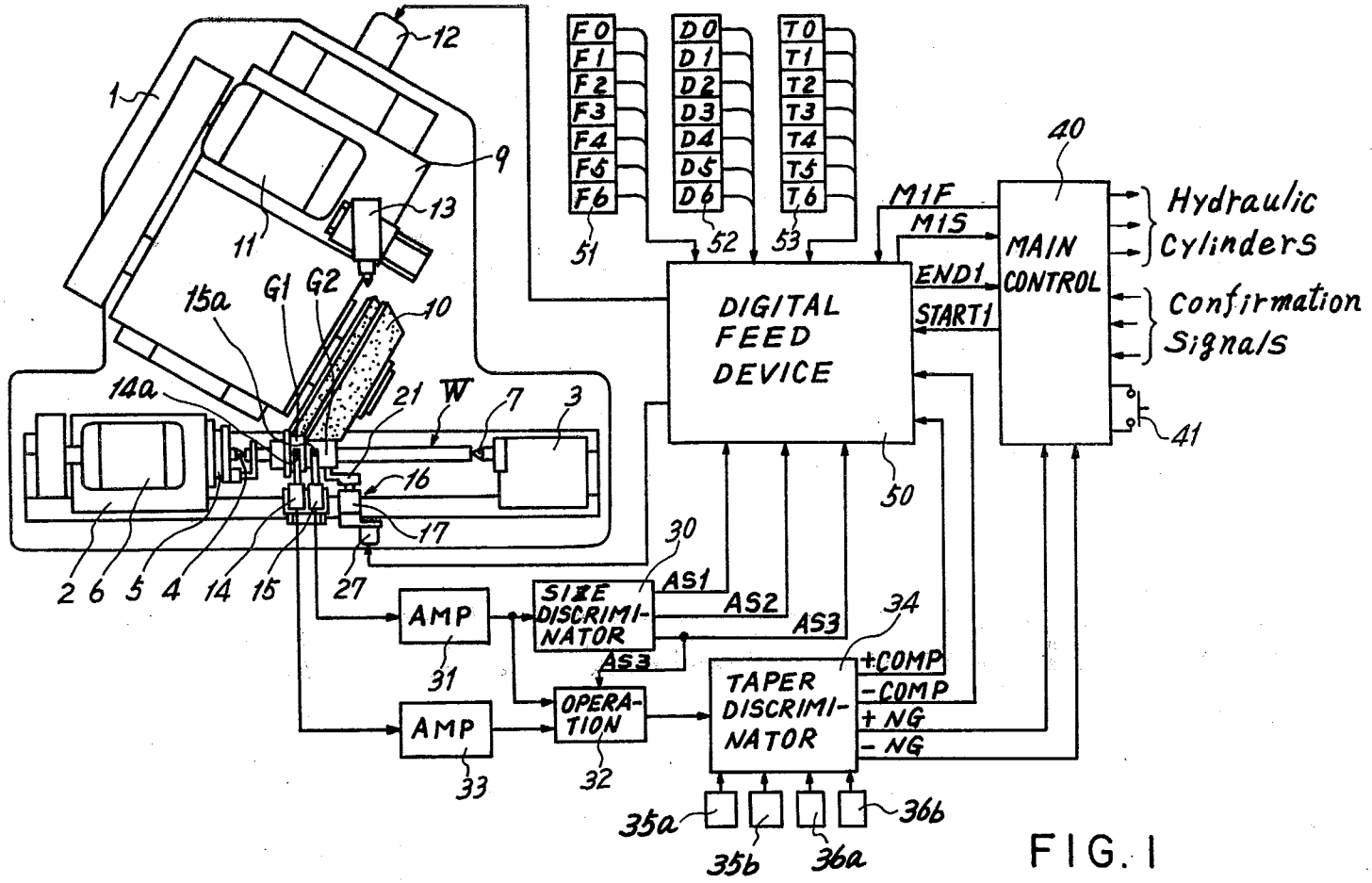
FIG. 1 is a plan view of a grinding machine with a rest apparatus according to the present invention, wherein a control circuit is schematically shown.

Referring now to the drawings, wherein like reference numerals or characters refer to identical or corresponding parts throughout the several views, and more particularly to FIG. 1, there is shown a bed 1 of a grinding machine. A head stock 2 and a tail stock 3 are mounted on the front portion of the bed 1 in such a manner as to be adjustable in a longitudinal direction. A spindle 5 having a center 4 at its one end is rotatably supported in the head stock 2 to be rotated by a drive motor 6 mounted on the head stock 2. Another center 7 is carried by the tail stock 3 in opposed relationship with the center 4. A deflectable workpiece W having ground portions G1 and G2 is rotatably supported between the centers 4 and 7. A wheel head 9 is slidably mounted on the rear portion of the bed 1 in such a manner as to be slidable in a direction at an acute angle with respect to the axis of the workpiece W. A grinding wheel 10 for grinding the ground portions G1 and G2 of the workpiece W is rotatably mounted by the wheel head 9 to be rotated by a drive motor 11 mounted on the wheel head 9. A servomotor 12 for moving the wheel head 9 together with a hydraulic cylinder, not shown, is secured at the rear portion of the bed 1. When feed command pulses are applied to the servomotor 12 from a digital feed device 50, which will be described later, the wheel head 9 is accurately moved by a distance depending upon the number of command pulses applied thereto at a speed depending upon a frequency of command pulses. A dressing device 13 is mounted on the wheel head 9 to dress the grinding wheel 10 into a predetermined shape. Each time a predetermined number of workpieces W are ground, the dressing device 13 is operated to dress the grinding surfaces of the grinding wheel 10 in parallel relationship with the axis of the workpiece W supported between the centers 4 and 7.

A pair of measuring heads 14 and 15 are movably mounted on the front portion of the bed 1 to measure diametral dimensions of the ground portions G1 and G2 of the workpiece W, respectively. When these measuring heads 14 and 15 are moved by a hydraulic cylinder, not shown, into their advanced positions, their measuring feelers 14*a* and 15*a* are aligned with the axis of the workpiece W and engaged with the ground portions G1 and G2 to generate signals indicative of the diametral dimensions thereof, respectively.

Figure 2:
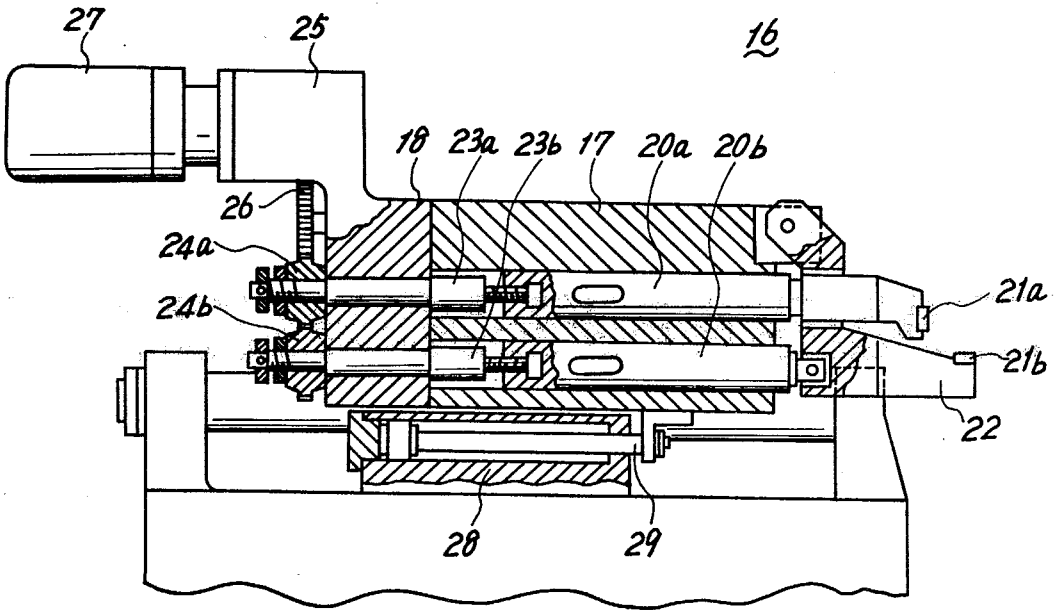
FIG. 2 is a sectional view of the rest apparatus shown in FIG. 1.

Referring now to FIG. 2, a rest apparatus 16 comprises a rest housing 17 which slidably but non-rotatably supports a pair of sliding rods 20*a* and 20*b*. The upper sliding rod 20*a* is provided at its one end with a rest shoe 21*a* to support the workpiece W horizontally. The lower sliding rod 20*b* is connected at its one end with a bend portion of an L-shaped arm 22 which is pivotally mounted on the front portion of the rest housing 17. Another rest shoe 21*b* is secured to the forward end of the arm 22 and is adapted to be moved upward to support the workpiece W vertically. The sliding rods 20*a* and 20*b* are threadedly engaged at their rear ends with threaded portions of a pair of shafts 23*a* and 23*b*, respectively, which are journalled in a bracket 18 fixedly secured to the rear end of the rest housing 17. The threads on the threaded portions of the shafts 23*a* and 23*b* are formed in opposite helix directions with each other. A pair of gears 24*a* and 24*b* engaging with each other are secured to the rear ends of the respective shafts 23*a* and 23*b*. A servomotor 27 is fixedly mounted on the bracket 18 and is connected with a reduction gearing unit 25 thereon which has an output gear 26 engaging with the gear 24*a* on the shaft 23*a*. Similar to the above-mentioned servomotor 12, the servomotor 27 is accurately rotated through an angle depending upon the number of command pulses applied thereto from the digital feed device 50 at a speed depending upon a frequency of command pulses. Therefore, when command pulses are applied to the servomotor 27, the shafts 23*a* and 23*b* are rotated in opposite directions in a synchronized manner. Since the threads on the shafts 23*a* and 23*b* are in opposite directions to each other, the sliding rods 20*a* and 20*b* are moved through a distance depending upon command pulses at a predetermined feed rate in the same direction. Accordingly, at the advanced position of the rest housing 17, the rest shoes 21*a* and 21*b* are accurately moved toward the axis of the workpiece W horizontally and vertically, respectively, through an amount depending upon command pulses. The rest housing 17 is connected with a piston rod 29 of a hydraulic cylinder 28 fixedly mounted on the bed 1 so as to be rapidly advanced and retracted toward and away from the workpiece W by the operation of the hydraulic cylinder 28.

Control circuits of the present embodiment will now be described. Referring back to FIG. 1, a size discrimination circuit 30 is connected through an amplifier 31 to the measuring head 15 to compare a signal indicative of the diametral dimension of the ground portion G2 with predetermined set values to generate various sizing signals. More specifically, the size discrimination circuit 30 generates a first sizing signal AS1 to complete a rough grinding operation on the ground portion G2, a second sizing signal AS2 to complete a fine grinding operation on the ground portion G2, and a third sizing signal AS3 to finish a grinding operation on the ground portion G2. These sizing signals AS1, AS2 and AS3 are applied to the digital feed device 50. The third sizing signal AS3 is also applied to an operation circuit 32.

The operation circuit 32 is effective to calculate a taper amount based upon dimensional difference between diametral dimensions of the ground portions G1 and G2. The operation circuit 32 is connected to the measuring heads 14 and 15 through amplifiers 33 and 31 to receive signals indicative of the diametral dimensions of the ground portions G1 and G2. When applied with the third sizing signal AS3 from the size discrimination circuit 30, the operation circuit 32 calculates a taper amount based upon signals from the measuring heads 14 and 15 and applies the same to a taper discrimination circuit 34. The taper discrimination circuit 34 compares the taper amount from the operation circuit 32 with positive and negative tolerance limits preset in preset devices 35*a* and 35*b*, and with positive and negative reference limits preset in preset devices 36*a* and 36*b*. The taper discrimination circuit 34 generates an abnormal signal +NG or −NG when the taper amount exceeds the tolerance limits and a compensation command +COMP or −COMP when the taper amount exceeds the reference limits. When the tolerance limits are set to $\pm\delta$, the reference limits are set, for example, to $\pm 0.5\delta$.

A main control circuit 40 is provided to enable an automatic grinding operation on the workpiece W. When a start switch 41 is depressed, the main control circuit 40 causes the drive motors 6 and 11 to be activated to rotate the workpiece W and the grinding wheel 10, and causes hydraulic cylinders (one being shown at 28 and the other being not shown) to rapidly advance the rest apparatus 16 and the measuring heads 14 and 15. When movements of the rest apparatus 16 and the measuring heads 14 and 15 into their rapid advanced positions by the hydraulic cylinders are confirmed by the limit switches, not shown, the main control circuit 40 generates a first start signal START1 to the digital feed device 50. When receiving an external operation start signal M1S from the digital feed device 50, the main control circuit 40 causes a hydraulic cylinder, not shown, to rapidly advance the wheel head 9. When movement of the wheel head 9 into its rapid advanced position is confirmed by a limit switch, not shown, the main control circuit 40 generates an operation finish signal M1F to the digital feed device 50. Furthermore, when receiving a grinding cycle finish signal END1 from the digital feed device 50, the main control circuit 40 causes the hydraulic cylinders to rapidly retract the wheel head 9, the measuring heads 14 and 15 and the rest apparatus 16 to their retracted positions.

The digital feed device 50 sequentially reads out preprogrammed program data to control rotations of the servomotors 12 and 27 so that the grinding wheel 10 and the rest shoes 21*a* and 21*b* are accurately moved through set distances at speeds based upon program data. The digital feed device 50 performs a normal grinding cycle, when receiving the first start signal START1 from the main control circuit 40 and performs a compensation cycle to compensate for advanced position of the rest shoe 21*a* when receiving the compensation command +COMP or −COMP from the taper discrimination circuit 34.

Digital switches 51, 52 and 53 are connected to the digital feed device 50. The digital switch 51 presets a variety of feed speeds F0 to F6, one of which is selected in response to a program data read out by the digital feed device 50. The digital switch 52 presets a variety of feed amounts D0 to D6, one of which is selected in response to a program data read out by the digital feed device 50. The digital switch 53 presets a variety of time periods T0 to T6, one of which is selected in response to a program data read out by the digital feed device 50.

Figure 3:
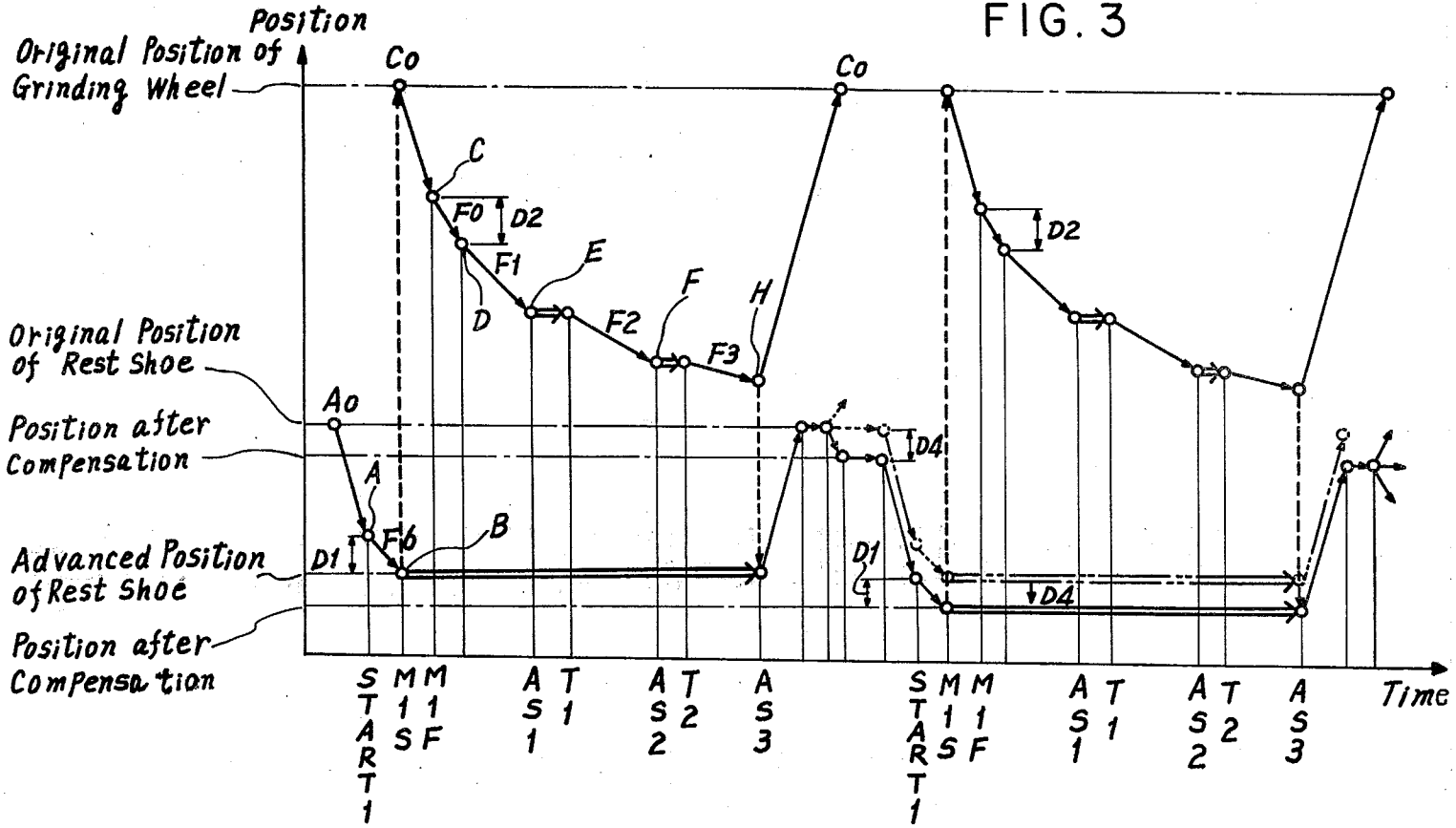
FIG. 3 is a grinding cycle diagram of the grinding machine according to the present invention.

The operation of the present embodiment will now be described with reference to the cycle diagram shown in FIG. 3. When the start switch 41 for the main control circuit 40 is depressed, the drive motors 6 and 11 are activated to rotate the workpiece W and the grinding wheel 10. At the same time therewith, the rest apparatus 16 is rapidly advanced by the hydraulic cylinder 28 from its original position A0 to its rapid advanced position A where the rest shoes 21*a* and 21*b* are a little separated from the ground portion G2 of the workpiece W, and the measuring heads 14 and 15 are rapidly advanced by the hydraulic cylinder, not shown, to their advanced positions where their measuring feelers 14*a* and 15*a* are engaged with the ground portions G1 and G2 to generate signals indicative of the diametral dimensions thereof.

When movements of the rest apparatus 16 and the measuring heads 14 and 15 into their advanced positions by the hydraulic cylinders are confirmed, the main control circuit 40 generates a first start signal START1 to the digital feed device 50, which therefore starts a normal grinding cycle. Accordingly, the servomotor 27 for the rest apparatus 16 is activated to rotate the shafts 23*a* and 23*b* in opposite directions to each other to thereby advance the sliding rods 20*a* and 20*b* toward the workpiece W at the feed speed F6 preset in the digital switch 51. When the rest shoes 21*a* and 21*b* are moved by the servomotor 27 through the feed amount D1 preset in the digital switch 52 into a position B, the workpiece W is a little bent toward the grinding wheel 10. When the rest shoes 21*a* and 21*b* are moved through the feed amount D1, the digital feed device 50 generates an external operation start signal M1S, so that the main control circuit 40 causes the hydraulic cylinder, not shown, to rapidly advance the grinding wheel 10 toward the workpiece W. When the grinding wheel 10 is moved from its original position C0 into its rapid advanced position C, the main control circuit 40 generates an operation finish signal M1F to the digital feed device 50, which thereby applies command pulses with a relatively higher frequency to the servomotor 12 so as to advance the grinding wheel 10 toward the workpiece W at a feed speed F0 preset in the digital switch 51.

When the grinding wheel 10 is moved at the feed speed F0 into a position D where the grinding surface of the grinding wheel 10 is just before the contact with the ground portions G1 and G2 of the workpiece W, the feed speed of the grinding wheel 10 is changed into a rough grinding feed speed F1 which is preset in the digital switch 51 and is slower than the feed speed F0. Accordingly, a rough grinding operation is performed on the ground portions G1 and G2 of the workpiece W which is under the condition of being supported by the rest apparatus 16.

When the ground portions G2 is ground into a dimension to finish the rough grinding operation, the size discrimination circuit 30 generates a first sizing signal AS1 at a position E of the grinding wheel 10, so that movement of the grinding wheel 10 toward the workpiece W is stopped for a predetermined time period T1 preset in the digital switch 53 to perform a sparkout grinding operation. When the sparkout grinding operation is finished after the predetermined time period T1 has lapsed, the grinding wheel 10 is again advanced toward the workpiece W at a fine grinding feed speed F2 which is preset in the digital switch 51 and is slower than the rough grinding feed speed F1 to perform a fine grinding operation. In the fine grinding operation, movement of the grinding wheel 10 is slower than that in the rough grinding operation so that the workpiece W is ground with less deflection than that in the rough grinding operation.

When the ground portion G2 is ground into a dimension to finish the fine grinding operation, the size discrimination circuit 30 generates a second sizing signal AS2 at a position F of the grinding wheel 10, so that movement of the grinding wheel 10 toward the workpiece W is stopped for a predetermined time period T2 preset in the digital switch 53 to perform a sparkout grinding operation. When the sparkout operation is finished after the predetermined time period T2 has lapsed, the grinding wheel 10 is advanced toward the workpiece W at a minute grinding feed speed F3 which is preset in the digital switch 51 and is slower than the fine grinding feed speed F2 to perform a minute grinding operation. In the minute grinding operation, feed movement of the grinding wheel 10 is very slow, so that an elastic deflection of the workpiece W, which may remain before the minute grinding operation is started, is substantially removed during the minute grinding operation to such an extent not to effect a generation of a taper in the ground portions G1 and G2.

When the ground portion G2 is ground into a finish dimension at a position H of the grinding wheel 10, the size discrimination circuit 30 generates a third sizing signal AS3, so that the grinding wheel 10 and the rest apparatus 16 are rapidly returned to their original positions C0 and A0, respectively.

When the third sizing signal AS3 is generated from the size discrimination circuit 30, the operation circuit 32 is made effective to calculate a taper amount based upon dimensional difference between diametral dimensions of the ground portions G1 and G2. The calculated taper amount is compared by the taper discrimination circuit 34 with the reference limits $\pm 0.5\delta$ and the tolerance limits $\pm\delta$. If the rest shoes 21*a* and 21*b* are worn out due to a considerable number of workpieces being ground, or if a diameter of the grinding surface for the ground portion G2 becomes smaller than that for the ground portion G1, the ground portion G1 is ground into a dimension smaller than a prdetermined finish dimension when the ground portion G2 is ground into a finish dimension, whereby a taper amount may exceed the negative reference limit $-0.5\delta$. In such a case, the compensation command +COMP is generated from the taper discrimination circuit 34. If a wheel spindle for supporting the grinding wheel 10 is deflected due to a thermal deformation of the wheel head 9, the ground portion G1 is not ground into the finish dimension, even if the ground portion G2 is ground into the finish dimension, whereby a taper amount may exceed the positive reference limit $+0.5\delta$. In such a case, the compensation command −COMP is generated from the taper discrimination circuit 34. When a taper amount exceeds the tolerance limits $\pm\delta$, it is determined that a normal taper compensation is not performed, whereby the taper discrimination circuit 34 generates an abnormal signal +NG or −NG to the main control circuit 40 to inform the same of an abnormality.

Assuming that a taper amount exceeds the negative reference limit $-0.5\delta$ due to the wear of the rest shoes 21*a* and 21*b*, the taper discrimination circuit 34 generates the compensation command +COMP to the digital feed device 50, which therefore causes the servomotor 27 for the rest apparatus 16 to be actuated. Accordingly, the rest shoe 21*a* is advanced through a feed amount D4 preset in the digital switch 52 and the rest shoe 21*b* is moved upward so as to grind a next workpiece W with a taper amount being within the reference limits $\pm 0.5\delta$. Consequently, the original position of the rest shoe 21*a* is advanced through the predetermined distance D4 and an advanced position of the rest shoe 21*a* in a next grinding cycle is compensated by using as a reference point the advanced position thereof at the grinding operation finish time in the preceding grinding cycle, whereby a taper amount of a workpiece ground in the next grinding cycle is kept within the reference limits. Each time a taper amount of a workpiece exceeds the reference limits in a subsequent grinding cycle, an advanced position of the rest shoe 21*a* is compensated, whereby a taper amount of the workpiece W does not exceed the tolerance limits, which results in an extremely accurate grinding operation.

Figure 4:
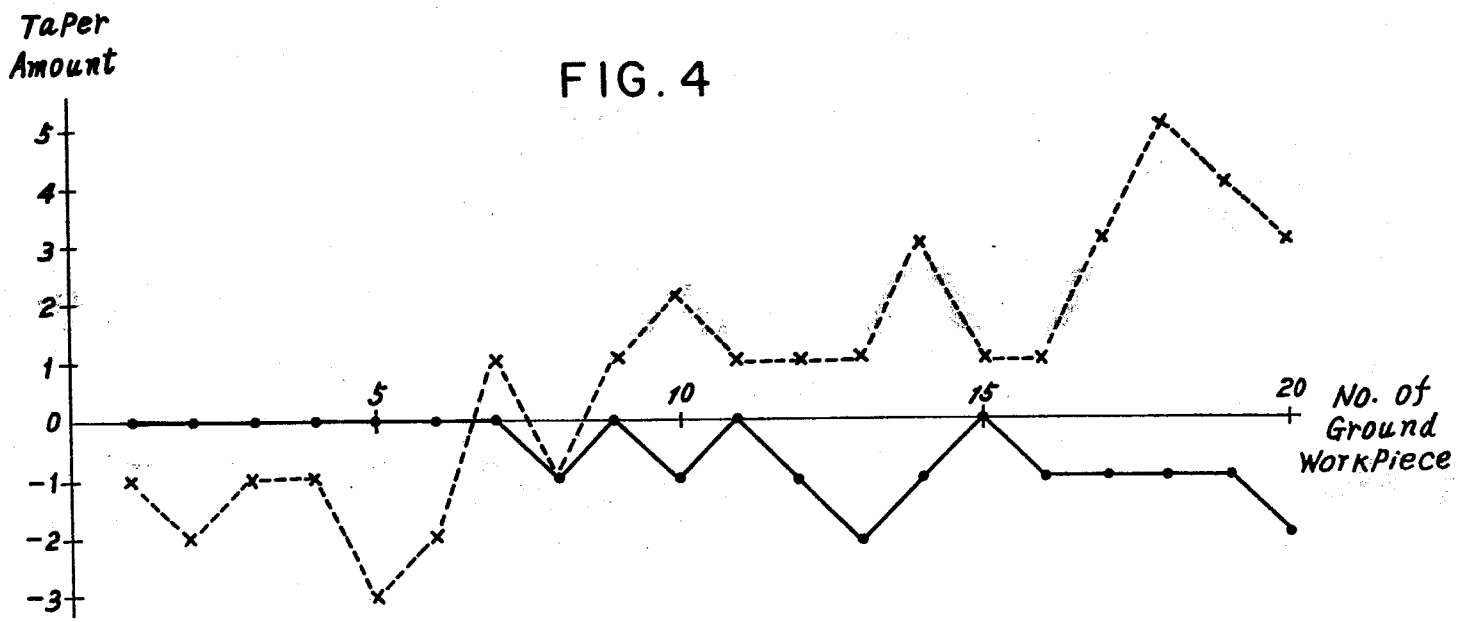
FIG. 4 is a graph showing a change in a taper amount of a workpiece.

In FIG. 4, a graph indicated in a solid line shows a change in a taper amount by a grinding operation according to the present invention. A change in a taper amount caused within an interval between two consecutive dressing operations is lowered below one half of that in the conventional manner, which proves a highly accurate grinding operation.

In the embodiment described above, it is detected that a taper amount exceeds the reference limits, and then an advanced position of the rest shoe 21*a* is compensated through a predetermined fix amount. However, an advanced position of the rest shoe may be compensated in accordance with a digital amount converted from a taper amount measured.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A grinding machine for grinding a workpiece comprising:

a bed;

means mounted on said bed for rotatably supporting said workpiece;

first drive means for rotating said workpiece;

a wheel head slidably mounted on said bed for rotatably supporting a grinding wheel thereon;

second drive means for rotating said grinding wheel;

a first servomotor for moving said wheel head so as to move said grinding wheel toward and away from said workpiece;

a rest apparatus comprising a pair of rest shoes movable toward said workpiece to support the same;

a second servomotor for moving said rest shoes;

means for measuring a diametral dimension of a workpiece during a grinding operation;

a main control circuit for sequentially enabling an automatic grinding operation;

first presetting means for digitally presetting variety of feed amounts;

second presetting means for digitally presetting a variety of feed speeds;

a digital feed device responsive to said measuring means and said main control circuit for selectively selecting one of the feed speeds preset in said first presetting means and one of the feed amounts preset in said second presetting means to cause one of said first and second servomotors to move one of said wheel head and said pair of rest shoes at a selected feed speed through a selected feed amount;

means for calculating a taper amount of a workpiece ground under the support of said rest shoes being positioned at their advanced positions at the time when said measuring means generates a signal for finishing a grinding operation on said workpiece; and means responsive to said calculating means for compensating for advanced positions of said rest shoes for a next grinding operation.

2. A grinding machine as set forth in claim 1, wherein said measuring means comprises a pair of measuring devices for measuring diametral dimensions of a workpiece on two separated points thereof, and wherein said calculating means calculates a taper amount of a workpiece in response to outputs of said two measuring devices.

3. A grinding machine as set forth in claim 2, wherein said compensating means compensates for advanced positions of said rest shoes for a next grinding operation when a taper amount of a workpiece ground in the preceeding grinding operation exceeds a reference limit.

4. A grinding machine as set forth in claim 3, wherein said compensating means generates an abnormal signal when a taper amount of a workpiece ground in the preceeding grinding operation exceeds a tolerance limit which is larger than the reference limit.

5. A grinding machine as set forth in claim 3 or 4, wherein said compensating means causes said digital feed device to select one of the feed speeds preset in said first presetting means and one of the feed amounts preset in said second presetting means so as to cause said second servomotor to compensate for advanced positions of said rest shoes at a selected feed speed through a selected feed amount for a next grinding operation when a taper amount of a workpiece ground in the preceeding grinding operation exceeds the reference limit.

* * * * *